United States Patent [19]

Tassie

[11] 4,437,384

[45] Mar. 20, 1984

[54] GUN MOUNT

[75] Inventor: Douglas P. Tassie, St. George, Vt.

[73] Assignee: General Electric Company, Burlington, Vt.

[21] Appl. No.: 293,716

[22] Filed: Aug. 17, 1981

[51] Int. Cl.[3] ..... F41F 21/04

[52] U.S. Cl. ..... 89/37 A; 89/41 M; 248/661

[58] Field of Search ..... 89/33 BB, 36 K, 37 A, 89/37 G, 37.5 A, 41 M; 248/178, 660, 661

[56] References Cited

U.S. PATENT DOCUMENTS

| | | | |
|---|---|---|---|
| 483,130 | 9/1892 | Bex . | |
| 2,014,762 | 9/1935 | Fergus | 89/37 |
| 2,178,291 | 10/1939 | Steurelein | 89/37.5 |
| 3,001,289 | 9/1961 | Carbonara | 33/61 |
| 4,280,394 | 7/1981 | Singenberger et al. | 89/37 A |
| 4,353,283 | 10/1982 | Crepin | 89/37 G |

FOREIGN PATENT DOCUMENTS

| | | | |
|---|---|---|---|
| 2843943 | 10/1979 | Fed. Rep. of Germany . | |
| 836197 | 1/1939 | France | 89/37.5 A |
| 2376394 | 7/1978 | France . | |
| 464543 | 4/1937 | United Kingdom | 89/37 A |
| 515993 | 11/1939 | United Kingdom | 89/37.5 A |

OTHER PUBLICATIONS

Maritime Defence, vol. 15, No. 6, Jun. 1980, p. 221.

*Primary Examiner*—Stephen C. Bentley
*Attorney, Agent, or Firm*—Bailin L. Kuch

[57] ABSTRACT

A feature of this invention is the provision of a three axis gun mount wherein the gun is mounted for movement in elevation and in train (azimuth) with respect to a platform which is disposed in a plane which is at an angle to the horizontal and which platform is mounted for movement about the zenith axis.

An additional feature of this invention is the provision of such a mount wherein said platform is provided with unlimited rotation in either direction about the zenith axis.

A yet additional feature of this invention is the provision of such a mount wherein the three axes of the mount, and the axis of the gun along which the firing impulse is applied to the mount, all have a common intersection.

7 Claims, 7 Drawing Figures

GUN MOUNT

BACKGROUND OF THE INVENTION

1. Field of the Invention

This invention relates to a mount which provides a gun with three axes of rotation whereby the gun can be pointed both straight up (zenith) and well below horizontal in all directions of azimuth.

2. Prior Art

French Patent No. 2,376,394 appears to show a gun for a vehicle mounted on three axes to accommodate side roll of the vehicle. U.S. Pat. No. 2,014,762 issued Sep. 17, 1935 to W. W. Fergus also appears to show an antiaircraft mount having three axes. Neither patent shows the concept of the three axes having a common intersection with the axis of the gun along which the firing impulse is applied to the mount. Other mounts for guns and other devices, such as telescopes, are shown in U.S. Pat. No. 3,001,289 issued Sep. 26, 1961 to V. E. Carbonara; German Patent No. 2,843,943; U.S. Pat. No. 2,178,291 issued Oct. 31, 1939 to G. Steuerlein; and U.S. Pat. No. 483,130 issued Sep. 27, 1892 to F. Bex. A two axis gun mount on a fixed, angled base, is shown in "Maritime Defense," Vol. 5, No. 6, June 1980, page 221.

SUMMARY OF THE INVENTION

It is an object of this invention to provide a mount which can progressively orient a gun along any radius, including zenith, within a portion of a sphere which is greater than a hemisphere.

It is another object of this invention to provide a three axis gun mount wherein the three axes have a common intersection with the axis of the gun along which the firing impulse is applied to the mount, thereby precluding gun firing forces from generating torques about any of the axes of rotation.

It is yet another object of this invention to provide a three axis mount wherein two of the axis drives are referenced to ground, thereby precluding the need for electrical slip rings for these drives.

It is still another object of this invention to provide a mount which can progressively orient a gun along any radius in a hemisphere without diminishing to zero the train track rate when the longitudinal axis of the gun is parallel to the train axis.

A feature of this invention is the provision of a three axis gun mount wherein the gun is mounted for movement in elevation and in train (azimuth) with respect to a platform which is disposed in a plane which is at an angle to the horizontal and which platform is mounted for movement about the zenith axis.

An additional feature of this invention is the provision of such a mount wherein said platform is provided with unlimited rotation in either direction about the zenith axis.

A yet additional feature of this invention is the provision of such a mount wherein the three axes of the mount, and the axis of the gun along which the firing impulse is applied to the mount, all have a common intersection.

DESCRIPTION OF THE DRAWING

These and other objects, features and advantages of the invention will be apparent from the following specification thereof taken in conjunction with the accompanying drawing in which.

DESCRIPTION OF THE INVENTION

Figure 1:
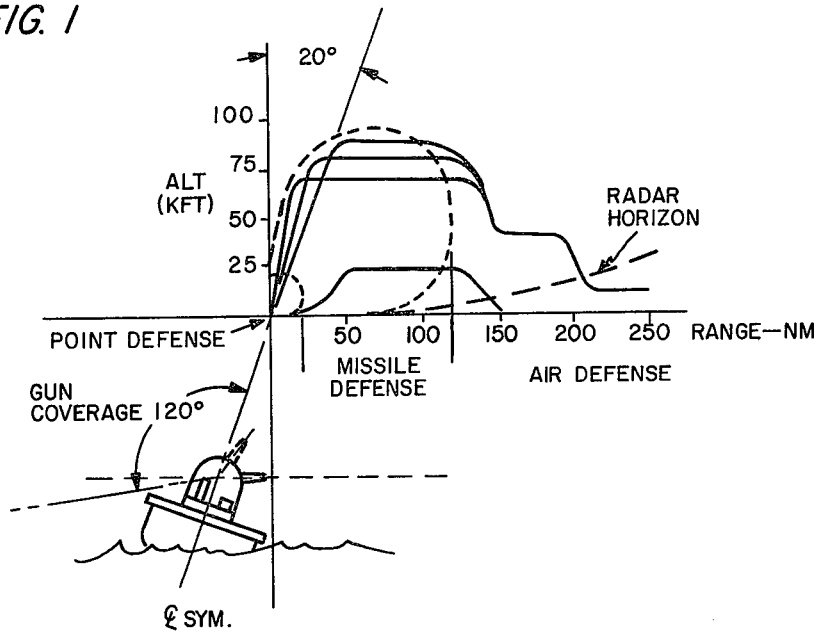
FIG. 1 is a diagram of certain naval antiair defense requirements.

FIG. 1 is a diagram of certain naval antiair defense requirements. It shows that antiship missiles may make their final approach to the target ship at angles of 20° or less from the zenith. To defeat such a threat, the target ship, in a point defense mode as it rolls from side to side, must be able to fire along the zenith axis, that is, to fire straight up. It is desirable that the target ship be able to fire along any radius within a sphere that is within 120° of the ship's zenith axis, so that it can also fire at more conventional threats along the horizon.

Figure 3A:
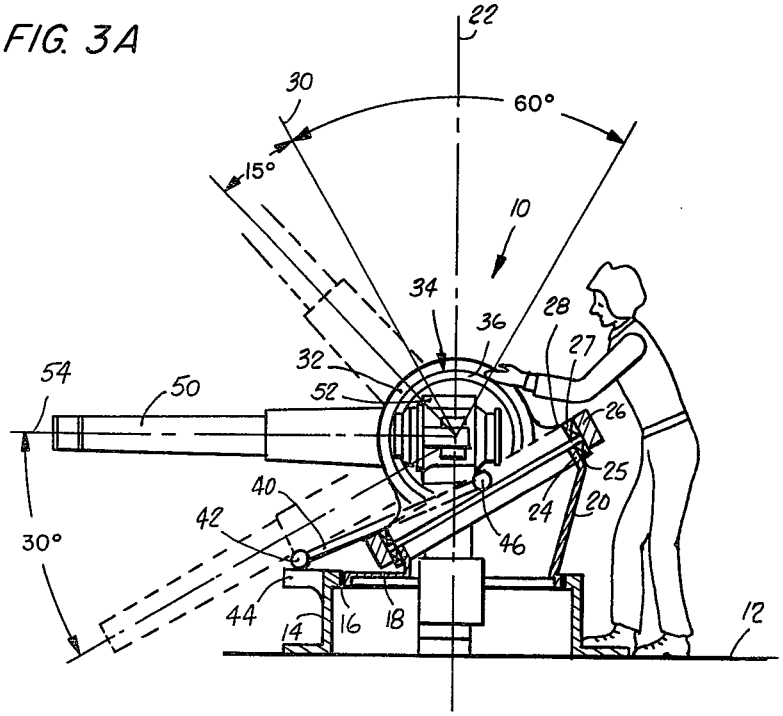
FIG. 3A is a view in side elevation of a first embodiment of the gun mount of FIG. 2A.
Figure 3B:
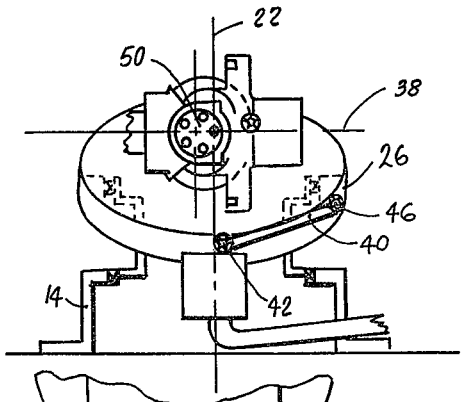
FIG. 3B is a view in front elevation of the first embodiment of FIG. 3A.

FIGS. 3A and 3B show a first embodiment of this invention. A gun mount 10 is fixed to a nominally horizontal deck 12 which in turn is fixed to a ship. (It will be appreciated that although this invention will be described in a naval environment, it also has utility on terrestial vehicles.) A horizontal ring 14 is fixed to the deck 12 and supports a ring bearing 16 on which is journaled the lower surface 18 of a wedge shaped element 20. The wedge shaped element 20 is able to rotate without limitation in either direction about the zenith axis 22. The upper surface 24 of the element 20 is fixed at an angle of 30° to the lower surface 18. The upper surface 24 supports a ring bearing 25 on which is journaled a reference ring 26 which supports a ring bearing 27 on which is journaled the train (azimuth) ring 28. The train ring 28 is able to rotate without limitation in either direction about the train (azimuth) axis 30. A fixed elevation ring 32 is fixed in a 90° plane to the train ring 28 and rotates with it about the train axis. The train ring 28 supports a ring bearing 34 on which is journaled the movable elevation ring 36. The ring 36 is able to pivot about the elevation axis 38 from an angle which is parallel to the upper surface 24 of the wedge shaped element 20 through a progressive angle up of 75° to an angle which is 15° below the train (azimuth) axis 30. A link 40 is pivotally mounted at its lower end by a ball and socket coupling 42 to the distal end of an arm 44 whose proximal end is fixed to the horizontal ring 14. The link 40 is pivotally mounted at its upper end by a ball and socket coupling 46 to the reference ring 26 which is journaled to the train ring 28. The rings 26 and 28 always remain in the same plane. A gun 50 is mounted by recoil adapters 52 to the movable elevation ring 36. The firing gun bore 54 and the recoil adapters lie in a common plane which also includes the zenith and train axes. The axis along which the firing impulse is transmitted to the movable elevation ring 36 intersects the zenith and train axes. The elevation axis passes through this common plane at the intersection of these axes. With this arrangement the gun firing loads do not create any torque about any of the three axes of rotation. The link 40 provides a fixed reference between the reference ring 26 and thereby the plane of the train ring 28, and the fixed horizontal ring 14.

Figure 2B:
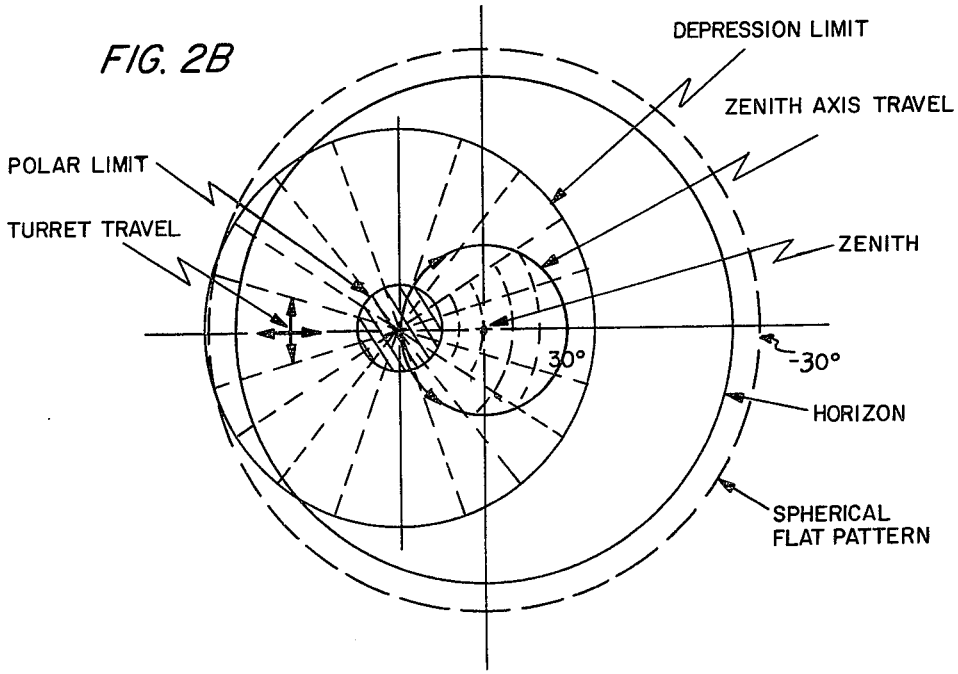
FIG. 2B is a diagram of the coverage in top plan of the gun mount of FIG. 2A.
Figure 2A:
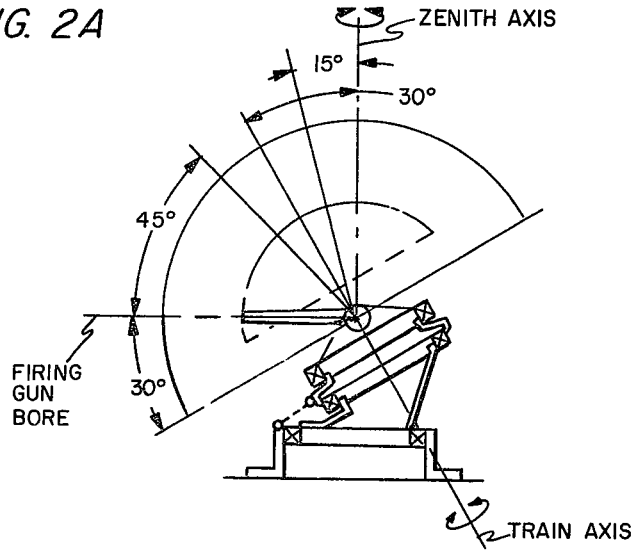
FIG. 2A is a diagram of the coverage in elevation of a gun mount embodying this invention.

FIG. 2A shows the elevation coverage of the gun mount.

FIG. 2B shows a spherical flat pattern which describes how the three axes interact. The polar limit of the gun mount as shown is 15° in elevation less than the train (azimuth) axis. This produces a conical blindspot of 30°. As the wedge shaped element 20 rotates about the zenith axis, this blindspot orbits the zenith axis. With this blindspot so movable, the gun can be pointed at any radius in the sphere from the zenith to 30° below the horizon, i.e., 120° from the zenith.

Versatility is available in controlling the movement of the gun mount since there are multiple angular orientations for each of the three axes for any desired one orientation of the gun. A very practical advantage is that the drive for the wedge shaped element and the drive for the train (azimuth) ring are referenced to ground, thereby eliminating electrical slip ring circuits for the zenith axis and train (azimuth) axis rotation.

Figure 4B:
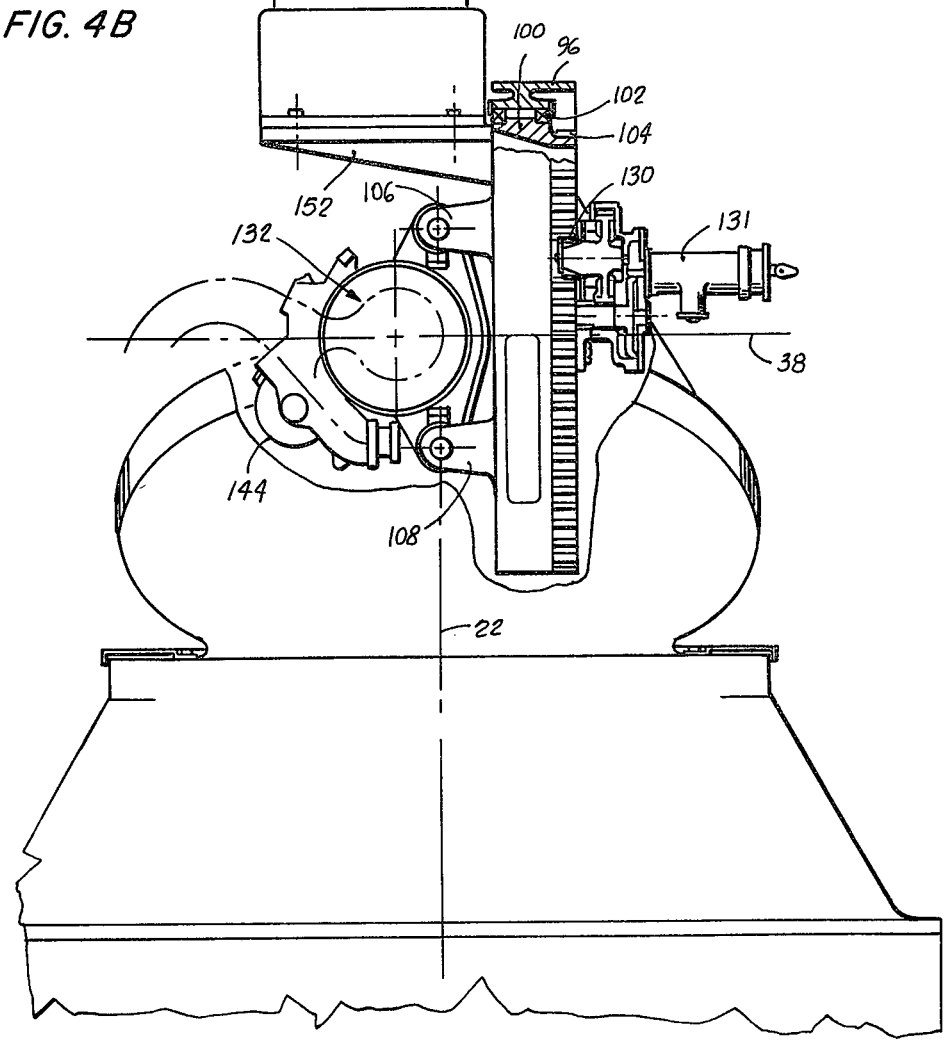
FIG. 4B is a view in rear elevation of the second embodiment of FIG. 4A.
Figure 4A:
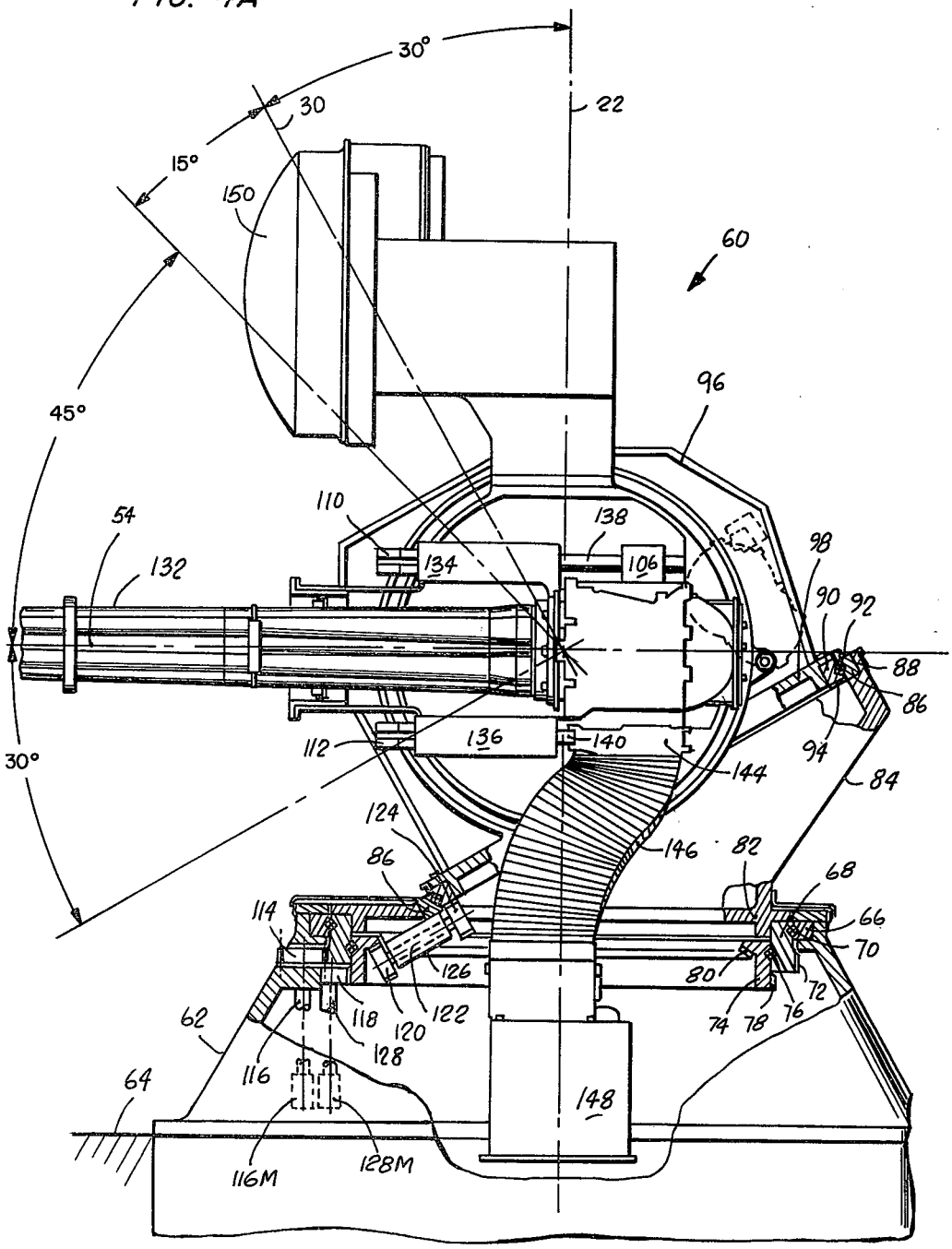
FIG. 4A is a view in side elevation of a second embodiment of the gun mount of FIG. 2A.

FIGS. 4A and 4B show a second and preferred embodiment of this invention which substitutes an epicyclic gear train for the reference link 40.

A gun mount 60 is mounted to a base ring 62 which is fixed to a deck 64. The outer race 66 of a three race and gear assembly is fixed to the ring 62. The middle race 68 is journaled to the outer race by a plurality of roller bearings 70 and has an integral annular gear 72. The inner race 74 is journaled to the middle race by a plurality of roller bearings 76 and has an integral annular gear 78 and an integral annular face gear 80. The base 82 of a wedge shaped element 84 is fixed to the middle race 68. An outer race 86 is fixed to the upper annulus 88 of the wedge shaped element. An inner race 90 is journaled to the outer race by a plurality of roller bearings 92 and has an integral annular face gear 94. A fixed elevation outer ring 96 is fixed in a normal plane to a train ring 98 which is fixed to the inner race 90. A movable elevation inner ring 100 is journaled to the outer ring 96 by a pair of antifriction bearings 102. The ring 100 has an integral annular gear 104, an aft pair of pillow blocks 106 and 108 and a forward pair of upstanding clevises 110 and 112.

A first drive is provided by a spur gear 114 which is meshed with the gear 72 which rotates the wedge shaped element 84 about the zenith axis 22. The gear 114 has an input drive shaft 116 which is journaled for rotation in a bore through the base ring 62.

A second drive is provided by a spur gear 118, which is meshed with the gear 78, which is integral with the gear 80, which is meshed with a spur gear 120 having an integral shaft 122 which is integral with the spur gear 124 and journaled for rotation in a pillow block 126 fixed to the underside of the base 82 of the wedge shaped element 84. The spur gear 124 is meshed with the face gear 94 which is fixed to the train ring 98. Thus the spur gear 118 rotates the train ring 98 about the train (azimuth) axis 30. The gear 118 has an input drive shaft 128 which is journaled for rotation in a bore through the base ring 62.

A third drive is provided by a spur gear 130 which is meshed with the gear 104 which rotates the movable elevation inner ring about the elevation axis. The gear 130 is driven by a gear box and an electric motor which are disposed in a housing 131 which is fixed to the fixed elevation ring 96. This motor must be coupled to a suitable electrical control circuit by means which will accommodate the movement of the fixed elevation ring 96 with respect to the wedge shaped element 84, and the movement of the wedge shaped element with respect to the base ring 62. This can be provided in the conventional manner by slip rings, not shown. A feature of this invention is that the other two drives, i.e., the electrical motors, 116M and 128M, which are coupled to the shafts 116 and 128, may be coupled to their electrical control circuits by fixed wiring since they are stationary with respect to ground.

A suitable gun 132, here shown as a five barrel gatling type gun, is fixed to the movable elevation inner ring. The gun and its mounting may be similar to that shown in U.S. Pat. No. 4,345,504 issued Aug. 24, 1982 to R. G. Kirkpatrick et al. The housing of the gun includes a pair of recoil adapters 134 and 136, having respective spindles 138 and 140, which are respectively mounted to and between the clevis 110 and the block 106 and the clevis 112 and the block 108. As the cluster of gun barrels 132 rotates, each barrel in sequence is loaded with a round, locked, fired, unlocked, and the fired case ejected. The round is fired at a time when the longitudinal axis of its barrel is in the same plane as the longitudinal axes of the spindles of the recoil adapters.

Ammunition may be provided to the gun as a belt of linked rounds coming into a stripper-feeder 144 of the gun from a chute 146 which is substantially coaxial with the zenith axis 22. The chute may be coupled to a rounds orientation mechanism 148 which is coaxial with the zenith axis and is of the type shown in Ser. No. 293,818 filed Aug. 17, 1981 by D. P. Tassie. This mechanism permits linked rounds to be fed from a stationary supply notwithstanding unlimited rotation of the gun mount about its zenith axis, or azimuth axis in the case of a two axis gun mount.

The gun mount may be provided with appropriate fire control mechanism such as a target acquisition radar 150 here shown fixed to a bracket 152 which extends from and is fixed to the movable elevation inner ring 100.

What is claimed is:

1. A mount, for an apparatus having a longitudinal axis, having three axes of rotation with respect to a reference plane comprising:

a zenith axis which is perpendicular to said reference plane, a train axis which is perpendicular to a tilted plane which is at an angle to said reference plane, an elevation axis which is parallel to said tilted plane, said mount including:

a support which is parallel to said reference plane;

a base which is journaled to said support for rotation about said zenith axis;

a train ring which is journaled to said base in a plane which is parallel to said tilted plane for rotation about said train axis;

an elevation ring which is journaled to said train ring in a plane which is perpendicular to said tilted plane for rotation about said elevation axis;

first drive means fixed to said support and coupled to said base for orienting said base about said zenith axis; and second drive means fixed to said support and coupled to said train ring for orienting said train ring about said train axis;

said first and second drive means being independently and concurrently operable to independently and concurrently drive said base and said train ring respectively.

2. A mount according to claim 1, wherein:

said zenith axis, said elevation axis, said train axis, and said longitudinal axis all intersect at a common point.

3. A mount according to claim 1, wherein:

said apparatus is a gun having a firing gun barrel coaxial with said longitudinal axis and a plurality of recoil adapters which are fixed to said elevation ring; and said longitudinal axis, said recoil adapters, said zenith axis and said train axis all lie in a common plane.

4. A mount according to claim 1, wherein:

said apparatus is a gun having a firing gun barrel coaxial with said longitudinal axis and a plurality of recoil adapters which are fixed to said elevation ring;

said longitudinal axis, said recoil adapters, said zenith axis and said train axis all lie in a common plane; and said zenith axis, said elevation axis, said train axis and said longitudinal axis all intersect at a common point in said common plane.

5. A mount according to claim 1, wherein:

said first drive means includes:

a motor having a housing fixed to said support and an output shaft which is fixed to a gear system which is fixed to said base.

6. A mount according to claim 4, wherein said second drive means includes:

a motor having a housing fixed to said support and an output shaft which is fixed to a gear system which is fixed to said train ring.

7. A mount according to claim 1, further including:

third drive means fixed to said train ring and coupled to the apparatus for orienting the apparatus longitudinal axis about said elevation axis;

said third drive means being independently and concurrently operable relative to said first and second drive means.

* * * * *